428-408

3/15/83 SR

OR 4,376,803

United States Patent [19]

Katzman

[11] 4,376,803

[45] Mar. 15, 1983

[54] CARBON-REINFORCED METAL-MATRIX COMPOSITES

[75] Inventor: Howard A. Katzman, Los Angeles, Calif.

[73] Assignee: The Aerospace Corporation, Los Angeles, Calif.

[21] Appl. No.: 296,957

[22] Filed: Aug. 26, 1981

[51] Int. Cl.[3] ..... B32B 9/00; B32B 9/04; B05D 3/12; B05D 3/02

[52] U.S. Cl. ..... 428/408; 427/57; 427/226; 427/314; 427/430.1; 428/389; 428/446; 428/448; 428/469; 428/902

[58] Field of Search ..... 427/57, 226, 255.6, 427/431, 314, 430.1; 428/610, 614, 627, 634, 469, 689, 408, 389, 902, 446, 448

[56] References Cited

U.S. PATENT DOCUMENTS

| | | | |
|---|---|---|---|
| 3,860,443 | 1/1975 | Lachman et al. | 427/214 |
| 4,082,864 | 4/1978 | Kendall et al. | 427/226 X |
| 4,223,075 | 9/1980 | Harrigan et al. | 428/610 |

*Primary Examiner*—Michael R. Lusignan
*Attorney, Agent, or Firm*—Ronald L. Taylor

[57] ABSTRACT

A carbon fiber reinforced metal matrix composite is produced by metal oxide coating the surface of the fibers by passing the fibers through an organometallic solution followed by pyrolysis or hydrolysis of the organometallic compounds. The metal oxide coated fibers so produced are readily wettable without degradation when immersed in a molten bath of the metal matrix material.

25 Claims, No Drawings

CARBON-REINFORCED METAL-MATRIX COMPOSITES

STATEMENT OF GOVERNMENT INTEREST

The invention described herein may be manufactured and used by or for the Government of the United States for governmental purposes without the payment of royalty therefor.

CROSS REFERENCE TO A RELATED PATENT APPLICATION

A patent application entitled, "Pyrolyzed Pitch Coatings for Carbon Fiber" bearing application No. 296,958, and filed on Aug. 26, 1981 by Howard A. Katzman and assigned to The Aerospace Corporation describes and claims a basic process upon which the present case is an improvement process therefor.

BACKGROUND OF THE INVENTION

1. Field of the Invention

This invention relates generally to the field of carbon reinforced metal matrix composition and specifically to fiber coatings that enhance wettability without the degradation thereof when exposed to molten metal.

2. Prior Art

Processes for manufacturing carbon or graphite-fiber-reinforced metal matrix composites which have relatively high strength-to-weight and stiffness-to-weight ratios have traditionally had the problem of carbon or graphite fiber resistance to wetting when immersed in molten baths of the metal matrix material and/or degradation of the fibers during the course of said wetting. What has been required then is a process whereby the fibers could be coated with a meterial that not only facilitates wetting, but also protects the fibers against chemical degradation during such processing. One of the prior art processes that has been used is chemical vapor deposition of a thin film of titanium (Ti)-boron (B) on the fiber to facilitate the wetting and alloying of (Ti-B) to the matrix metal to reduce migration of the coating as described in U.S. Pat. No. 3,860,443 of Jan. 14, 1975 to Lachman et al., U.S. Pat. No. 4,082,864 of Apr. 4, 1978 to Kendall et al, and U.S. Pat. No. 4,223,075 of Sept. 16, 1980 to Harrigan, et al. Such deposition, although a meritorious improvement over other prior art methods, is still relatively expensive and not always consistent as to results. Accordingly, there was a need for a process that would enhance the wettability of graphite/carbon fiber while disallowing degradation during the immersion in the molten bath of the metal matrix material.

SUMMARY OF THE INVENTION

It is an important object of the invention to uniformly deposit a metal oxide-coating on the surface area of a carbon fiber for the purpose of enhancing wetability of the fiber in a molten bath of a metal matrix material without seriously degrading the characteristics of the fiber during such a process step. It is another important object of the invention to pass the carbon fibers through organometallic solutions followed by pyrolysis or hydrolysis of the organometallic compounds to yield the desired metal oxide coating on the surface of the fiber.

It is yet another important object of the invention to pass the carbon fibers through organometallic solutions followed by hydrolysis of the organometallic compounds to yield the desired metal oxide coating on the surface of the fiber.

DESCRIPTION OF THE PREFERRED EMBODIMENT

The fibers used in the embodiment of the present invention are amorphous carbon with relatively high strength and relatively low modulus, or are partially or wholly graphitic with relatively high strength and high modulus. A typical strand of carbon or graphite yarn consists of 1,000 to 12,000 continuous filament or multifilaments each of approximately seven to eleven microns in diameter. These fibers are commercially available under such trade names or trade-marks as FORTAFIL (Great Lakes Carbon Corp.), Thornel Union Carbide Corp.) and MODMOR (Whittaker-Morgan, Inc.). The present embodiment uses Thornel 300 PAN-based graphite fibers, but is not limited thereto.

The initial steps in processing the graphite fibers enhances their wettability and infiltration by the metal matrix material. In this step, uniform metal oxide coatings are deposited on the surface of the fibers by passing the fiber bundles through various organometallic solutions followed by pyrolysis or hydrolysis of the organometallic compound to yield the desired coating. Those oxide-coated fibers are readily wettable when immersed in a molten metal bath. The metal oxide coatings so made form strong chemical bonds with both the graphite fibers and the metal matrices resulting in composites with relatively higher transverse strength, better corrosion resistance and improved high temperature stability compared with currently produced composites.

The solution coating process makes use of a class of organometallic compounds known as alkoxides in which metal atoms are bound to hydrocarbon groups by oxygen atoms. The general formula is $M(OR)_x$, where R is any hydrocarbon group such as methyl, ethyl or propyl. The subscript $_x$ is the oxidation state of the metalatom, M. These alkoxides hydrolyze when exposed to water or water vapor ($H_2O$) according to the general equation:

$$(M(OR)_x+(x/2)H_2O=MO_{x/2}+xROH$$

As an example, the alkoxide tetraethoxy silane is hydrolyzed by water as follows:

$$Si(OC_2H_5)_4+2H_2O=SiO_2+4C_2H_5OH$$

The $C_2H_5OH$ or ethyl alcohol is a nonessential hydrocarbon by-product of the process. Alkoxides can also be pyrolyzed to yield oxides. Tetraethoxy silane pyrolyzes as follows:

$$Si(OC_2H_5)_4=SiO_2+2C_2H_5OH+2C_2H_4$$

Again, ethyl alcohol is a nonessential hydrocarbon by-product as is $C_2H_4$ or ethylene.

A partial list of metals or metal-like elements for which alkoxides are commercially available includes silicon (Si), titanium (Ti), vanadium (V), lithium (Li), magnesium (Mg), sodium (Na), potassium (K), zirconium (Zr), and boron (B). Most alkoxides can be dissolved in an organic solvent such as toluene to produce organometallic solutions simulating the composition of various ceramics. The fibers are passed through this solution and they are hydrolyzed or pyrolyzed to transform the alkoxides into oxides on the surfaces of the fibers. By controlling the solution concentration, time and temperature of immersion, it is possible to control the uniformity and thickness of the resulting oxide coatings.

For some metallic or metallic-like elements such as silicon (Si), titanium (Ti) and boron (B), the oxides are more stable than the chlorides and are hydrolyzed by water or water vapor ($H_2O$). As an example:

$$SiCl_4+2H_2O=SiO_2+4HCl$$

That is, silicon chloride ($SiCl_4$) plus water ($H_2O$) hydrolyzes to give silicon dioxide ($SiO_2$) plus hydrogen chloride (HCl). These chlorides are generally more reactive than the alkoxides and are also soluble in toluene. Therefore a mixture of chlorides and alkoxides can be used in order to control the reactivity of the toluene solution. Stated alternatively, the reaction proceeds at a relatively higher rate in the presence of chloride, but will react in any case at a slower rate without chlorides.

As an example of the process, the coating of Thornel 500, PAN based graphite fibers with silicon-dioxide ($SiO_2$) will be described as follows. The graphite fiber tows or bundles pass sequentially through: first, a three hundred fifty to four hundred and fifty degree centigrade, but preferably a four hundred degrees centigrade furnace under air or an inert gas such as argon (Ar) to vaporize or burn off any sizing, such as polyvinyl alcohol (PVA); secondly, an ultrasonic bath containing a toluene solution of silicon tetrachloride ($SiCl_4$) (five percent by volume) and tetraethoxy silane [$Si(OC_2H_5)_4$](5% by volume) at twenty to one hundred degrees centigrade; thirdly, a chamber containing flowing steam ($H_2O$) which hydrolyzes the silicon tetrachloride ($SiC)_4$) and tetraethoxy silane [$Si(OC_2H_5)_4$] on the graphite fiber surface; and fourthly, a drying furnace at three hundred to seven hundred and fifty, but preferably seven hundred degrees centigrade under an inert gas such as argon (Ar) which vaporizes any excess organic solvent such as toluene and water ($H_2O$), and pyrolyzes any unhydrolyzed silicon (Si) compounds to oxide which is in this case silicon dioxide ($SiO_2$). The graphite or carbon fibers move at a rate of two feet per minute which results in a residence time in the organic solvent which is in this case toluene solution of approximately thirty seconds.

Examination of the oxide coated graphite fibers with the Scanning Auger Microprobe (SAM) reveals a uniform metallic oxide which is in this case a silicon-dioxide ($SiO_2$) coating on all of the graphite filaments. No residual chloride (Cl) from the toluene solution containing silicon tetrachloride ($SiCl_4$) was detected indicating complete hydrolysis. SAM depth profiles show that the oxide coating, which is in this case silicon dioxide ($SiO_2$), on the graphite fibers vary in thickness from seven hundred to fifteen hundred angstroms with an average value of approximately one thousand angstroms. Transmission electron microscopy verifies these thickness values. Both electron and X-ray diffraction, indicates that the coating which is in this case silicon-dioxide ($SiO_2$), is amorphous.

When the oxide, which is in this case silicon-dioxide ($SiO_2$), coated graphite fibers are immersed in liquid magnesium (Mg) at six hundred and seventy degrees centigrade for approximately ten seconds, the magnesium metal spontaneously wets the silicon dioxide ($SiO_2$) coating and infiltrates into the graphite fiber bundles. SAM analysis indicates that silicon (Si) is present at the graphite fiber/metal matrix interface, and that the interfacial layer consists of magnesium silicate. This has been confirmed with secondary ion mass spectroscopy.

Metallic oxide coatings can be produced by the above method that will facilitate the wetting of any type of graphite fiber by any molten metal and its alloys. The above process has particularly useful application in regards to the production of various magnesium (Mg) and/or aluminum (Al) alloys reinforced with graphite fibers since there is a need for lightweight frame structures in aerospace applications that can be easily produced. Other metal matrix materials include lead, zinc, copper, tin and alloys thereof.

Novel features of the invention include the use of metal oxide coatings to facilitate wetting of graphite fibers, and the use of alkoxide and organometallic solutions to deposit uniform metal oxide coatings on the surfaces of fibers.

From the foregoing description of a specific embodiment illustrating the fundamental features of the invention, it will now be apparent to those skilled in the art that the invention may be accomplished in a variety of forms without departing from the true spirit and scope thereof. Accordingly, it is understood that the invention disclosed herein is a preferred embodiment thereof and that the invention is not be limited thereby, but only by the appended claims.

What is claimed is:

1. A carbon fiber reinforced metal matrix comprising:
(a) a continuous multifilament carbon fiber;
(b) an oxide film operative to coat substantially surfaces of the multifilament carbon fiber; and
(c) a metal matrix material infiltrated throughout and adhered to the multifilament carbon fiber.

2. The carbon fiber reinforced metal matrix as defined in claim 1 wherein the oxide is silicon-dioxide.

3. The carbon fiber reinforced metal matrix as defined in claim 1 wherein the metal matrix material is substantially magnesium.

4. The carbon fiber reinforced metal matrix as defined in claim 1 wherein the carbon fiber is substantially a graphite fiber.

5. A composite product comprising a plurality of carbon fibers each having a coating of an oxide formed with an element selected from the group consisting of silicon, titanium, vanadium, lithium, magnesium, sodium, potassium, zirconium, boron, or alloys thereof, said fibers being disposed in a substantially solid matrix of metal.

6. A composite as defined in claim 5 wherein the thickness of said coating is within the range of approximately between seven hundred to fifteen hundred angstroms.

7. A composite as defined in claim 5 wherein the fibers are substantially graphite.

8. A composite as defined in claim 5 wherein the metal matrix is substantially magnesium.

9. A process for improving the wettability of multifilament carbon fibers by molten metal by coating the fibers with an oxide comprising:
(a) immersing the fibers in an ultrasonic bath containing an organic solvent solution having alkoxides therein at a predetermined temperature; and
(b) flowing steam by the fibers to hydrolyze the alkoxides to oxide on the surface of the fiber to a predetermined thickness.

10. The process as defined in claim 9 wherein the alkoxide in the immersing step comprises tetraethoxy silane.

11. The process as defined in claim 9 wherein the predetermined temperature in the immersing step may be within the range of approximately twenty to one hundred degrees centigrade.

12. The process as defined in claim 9 wherein the oxide in the flowing steam step has a predetermined thickness they may be within the range of approximately seven hundred to fifteen hundred angstroms.

13. The process as defined in claim 9 wherein the oxide in the flowing steam step comprises silicon-dioxide.

14. A process for improving the wettability of multifilament carbon fibers by molten metal by coating the fiber with an oxide comprising the steps of:

(a) heating the fibers to a predetermined temperature to pyrolyze and vaporize the sizing;

(b) immersing the fibers in a ultrasonic bath at a predetermined temperature containing an organic solvent solution having chlorides and alkoxides therein;

(c) flowing steam by the fibers to hydrolyze the alkoxides to form an oxide on the surface of the fiber to a predetermined thickness; and (d) drying the fibers at a predetermined temperature in an inert atmosphere for vaporizing excess water and the organic solvent, and for pyrolyzing any unhydrolyzed compounds into the oxide.

15. A process for improving the wettability of multifilament carbon fibers by molten metal by coating the fibers with an oxide comprising the steps of:

(a) vaporizing off sizing on the fiber by heating it to a predetermined temperature;

(b) immersing the fibers in an ultrasonic bath at a predetermined temperature containing an organic solvent solution having chlorides and alkoxides therein;

(c) flowing steam by the fibers to hydrolyze the chlorides and alkoxides to an oxide on the surface of the fiber to a predetermined thickness; and (d) drying the fibers at a predetermined temperature in an inert atmosphere for vaporizing excess water and the organic solvent, and for pyrolyzing any unhydrolyzed compounds into the oxide.

16. The process as defined in claim 15 wherein the predetermined temperature in the vaporizing step, is within the range of approximately three hundred fifty to four hundred fifty degrees centigrade.

17. The process as defined in claim 15 wherein the organic solvent in the immersing step is toluene.

18. The process as defined in claim 15 wherein the chloride in the organic solvent solution of the immersing step comprises silicon tetrachloride.

19. The process as defined in claim 15 wherein the alkoxide in the organic solvent solution in the immersing step comprises tetraethoxy silane.

20. The process as defined in claim 15 wherein the predetermined temperature in the immersing step is within the range of approximately twenty to one hundred degrees centigrade.

21. The process as defined in claim 15 wherein the oxide in the flowing steam step has a predetermined thickness that is within the range of approximately seven hundred to fifteen hundred angstroms.

22. The process as defined in claim 15 wherein the oxide in the flowing steam step comprises silicon-dioxide.

23. The process as defined in claim 15 wherein the predetermined temperature of the drying step is within the range of approximately three hundred to seven hundred fifty degrees centigrade.

24. The process as defined in claim 15 wherein the inert atmosphere of the drying step is substantially argon.

25. The process as defined in claim 15 wherein the compounds in the drying step are substantially silicon compounds.

* * * * *